US005601401A

United States Patent [19]

Matheny et al.

[11] Patent Number: 5,601,401

[45] Date of Patent: Feb. 11, 1997

[54] VARIABLE STAGE VANE ACTUATING APPARATUS

[75] Inventors: Alfred P. Matheny, Jupiter; Brian H. Terpos, Palm City, both of Fla.

[73] Assignee: United Technologies Corporation, Hartford, Conn.

[21] Appl. No.: 576,413

[22] Filed: Dec. 21, 1995

[51] Int. Cl.[6] ..... F01D 17/12

[52] U.S. Cl. ..... 415/160

[58] Field of Search ..... 415/159, 160

[56] References Cited

U.S. PATENT DOCUMENTS

| | | | |
|---|---|---|---|
| 3,954,349 | 5/1976 | Abild | 415/160 |
| 3,990,809 | 11/1976 | Young et al. | 415/160 |
| 4,979,874 | 12/1990 | Myers | 415/160 |
| 5,000,659 | 3/1991 | Catte et al. | 415/160 |
| 5,314,301 | 5/1994 | Knight | 415/160 |

*Primary Examiner*—F. Daniel Lopez
*Assistant Examiner*—Michael S. Lee

[57] ABSTRACT

An apparatus for actuating variable stage vanes is provided having a plurality of pivot arms, a synchronizing ring, and apparatus for pivotly attaching the pivot arms to the synchronizing ring. Each pivot arm includes a first end for fixed attachment with one of the vanes. The synchronizing ring includes a first flange, a second flange, a web extending between the flanges, and a plurality of openings disposed in the web. The apparatus for pivotly attaching the pivot arms to the synchronizing ring are disposed within the openings.

5 Claims, 2 Drawing Sheets

VARIABLE STAGE VANE ACTUATING APPARATUS

The invention was made under a United States Government contract and the Government has rights therein.

BACKGROUND OF THE INVENTION

1. Technical Field

This invention relates to gas turbine engines having variable stage vanes in general, and to apparatus for actuating variable stage vanes in particular.

2. Background Information

Vane assemblies increase efficiency and performance within gas turbine engines by directing air at an optimum flow path for downstream components. The flow path of air exiting a vane is influenced by the orientation, or the "angle of attack", of the vane. In some sections of the engine, the optimum angle of attack varies with the thrust setting of the engine and "where" the engine is within its flight envelope. Hence, stationary vanes only provide an optimum air flow path for a portion of the performance envelope of the engine. Variable stage vanes, on the other hand, may be manipulated to change the angle of attack and consequently can provide an optimum air flow path for a variety operating conditions.

Variable vane assemblies typically include a plurality of vanes circumferentially distributed and pivotly disposed between an inner vane support and an outer casing. Each vane typically includes a post extending up through the outer casing and a pivot arm fixed to the post on the opposite side of the outer casing. The fixed attachment between each vane and pivot arm causes the pivot arms and the vanes to pivot together about the same axis. All of the pivot arms are pivotly attached to a synchronizing ring disposed between, and concentric with, the outer casing and the nacelle (or engine bay depending upon the application). An actuator provides the means for driving the synchronizing ring along the circumference of the outer casing.

When a change in operating conditions makes it advantageous to change the vane angle of attack, the actuator is directed to circumferentially rotate the synchronizing ring to a new circumferential position associated with a particular vane angle of attack. The pivot arms, and the vanes fixed to the pivot arms, rotate with the synchronizing ring. Under ideal circumstances, the synchronizing ring is concentric with the outer casing and readily rotated between positions. Under more common circumstances, however, air flow forces acting against the vanes force the synchronizing ring out of round, and into contact with the outer casing. Contact between the synchronizing ring and outer casing inhibits motion and can prevent proper positioning of the ring.

The point at which the pivot arm acts on the synchronizing ring also affects the roundness of the ring. Pivot arms attached to the inner or outer radial surface of the synchronizing ring produce moments which, if of sufficient magnitude, can increase deflection of the ring and add to any out of round condition that may exist. Moments acting on the ring can also introduce additional undesirable stresses within the ring.

In short, what is needed is an apparatus for actuating variable vanes that facilitates actuation by maintaining concentricity with the outer casing and minimizing stress within the synchronizing ring.

DISCLOSURE OF THE INVENTION

It is, therefore, an object of the present invention to provide an apparatus for actuating variable stage vanes that is readily actuated.

It is a further object of the present invention to provide an apparatus for actuating variable stage vanes that minimizes mechanical stresses in the synchronizing ring.

It is a still further object of the present invention to provide an apparatus for actuating variable stage vanes that requires a minimal radial annulus.

According to the present invention, an apparatus for actuating variable stage vanes is provided having a plurality of pivot arms, a synchronizing ring, and means for pivotly attaching the pivot arms to the synchronizing ring. Each pivot arm includes a first end for fixed attachment with one of the vanes. The synchronizing ring includes a first flange, a second flange, a web extending between the flanges, and a plurality of openings disposed in the web. The means for pivotly attaching the pivot arms to the synchronizing ring are disposed within the openings.

The present invention apparatus for actuating variable stage vanes provides several advantages over existing actuating apparatus. A first advantage is that vane actuation is facilitated because the synchronizing ring possesses sufficient stiffness to resist deformation. Stiffness is a function of the modulus of elasticity ("E") of the ring material and the moment of inertia ("I") of the ring about a neutral axis. The choice of materials for the ring is usually constrained by the weight of material and the thermal properties of the material. In some applications, synchronizing ring material may be limited to one or two choices having appropriate thermal characteristics but less than optimum mechanical strength properties. Hence, ring material alone may not provide sufficient stiffness.

The ring's moment of inertia, on the other hand, is related to the cross-sectional geometry of the ring which can be adapted to increase the moment of inertia and therefore the stiffness of the ring. An increase in the web span of an "I"-shaped ring, for example, will increase the ring's moment of inertia about an axis passing through the web of the "I". A person of skill in the art will recognize, however, that it is not always practical to increase the radial dimension of the synchronizing ring. In fact, it is advantageous to minimize the radial area devoted to the apparatus annulus. It is known to attach pivot arms to the outer radial surface of the synchronizing ring. In that configuration, the pivot arms add to the radial area necessary for the synchronizing ring without increasing the moment of inertia of the ring. The present invention, on the other hand, optimizes the radial area available by pivotly attaching the pivot arms within openings disposed in the web of the ring. The synchronizing ring, as a result, extends across the entire annulus and has a greater degree of stiffness than would be otherwise possible under prior art configurations.

Another advantage of the present invention is that stress associated with the attachments between the pivot arms and the synchronizing ring is minimized. For purposes of explanation, the ring may be viewed as a simple beam with an applied bending moment. At the neutral axis of the beam, stress is considered to be negligible or nil. Traveling away from the neutral axis in one direction, stress is compressive and increasing until the outer edge where the stress is at a maximum. Traveling away from the neutral axis in the opposite direction, stress is tensile and similarly increases until it reaches a maximum at the outer edge. Hence, the maximum stress areas of the beam are at the outer edges. The present invention avoids those high stress areas by allowing the pivot arms to act on or near the neutral axis of the ring cross-section. As a result, bending moments acting on the ring are eliminated or minimized and the stress associated with the moments as well.

These and other objects, features and advantages of the present invention will become apparent in light of the detailed description of the best mode embodiment thereof, as illustrated in the accompanying drawings.

BEST MODE FOR CARRYING OUT THE INVENTION

Figure 1:
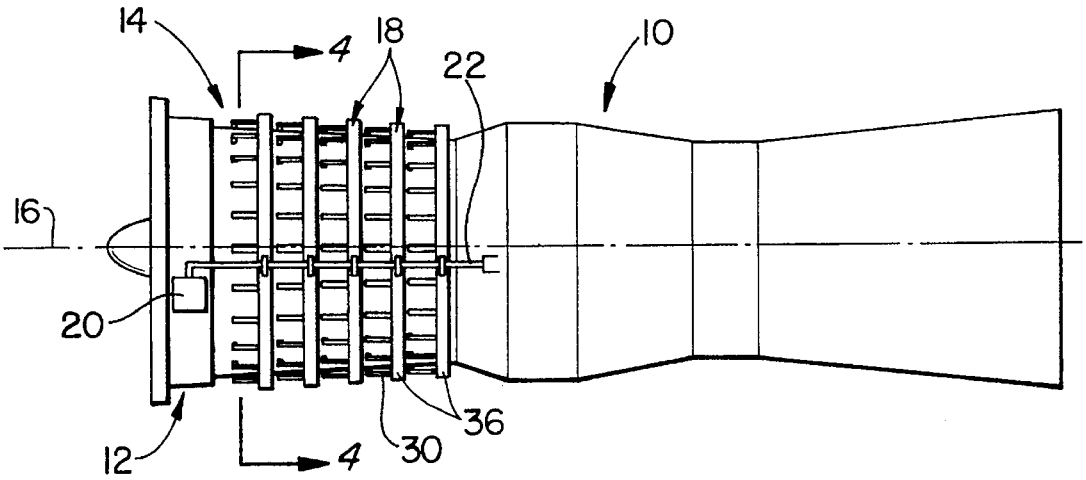
FIG. 1 is a diagrammatic side view of a gas turbine engine which includes that has a synchronizing ring of the present invention.

Now referring to FIG. 1, a gas turbine engine 10 includes a fan section 12 and a compressor section 14 disposed around a center axis 16. The compressor section 14 includes a plurality of variable stage vane assemblies 18 driven by an actuator 20 and linkage 22. For illustrative purposes, the nacelle normally disposed outside the fan 12 and compressor 14 sections is not shown.

Figure 2:
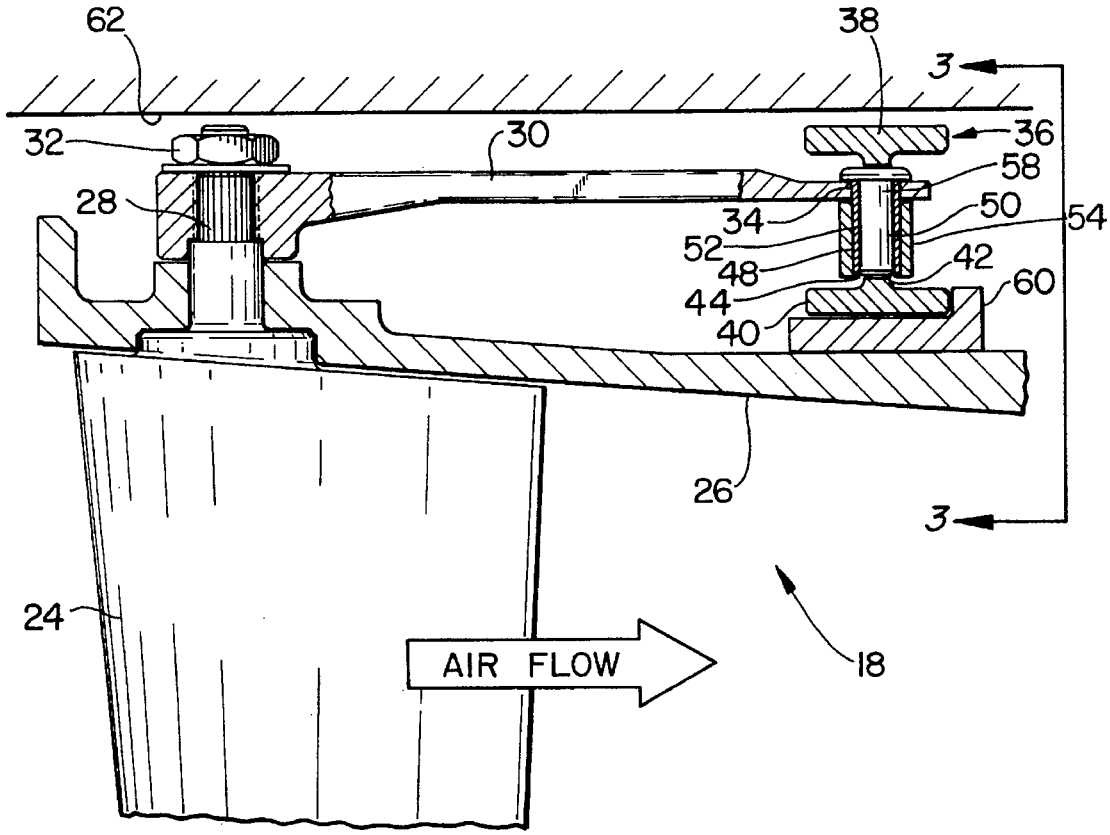
FIG. 2 is a diagrammatic cross-sectional side view taken along line 2—2 of FIG. 4.

Referring to FIG. 2, each variable stage vane assembly 18 includes a plurality of vanes 24 pivotly disposed and circumferentially spaced between an inner vane support (not shown) and an outer casing 26. Each vane 24 includes a post 28 extending up through the outer casing 26. Each post 28 is received within a pivot arm 30 located on the side of the outer casing 26 opposite the vane 24. In the embodiment shown in FIG. 2, each pivot arm 30 is fixed to a post 28 by a conventional fastener 32. Each pivot arm 30 further includes an aperture 34 positioned a distance from the where the post 28 is received within the arm 30.

Figure 3:
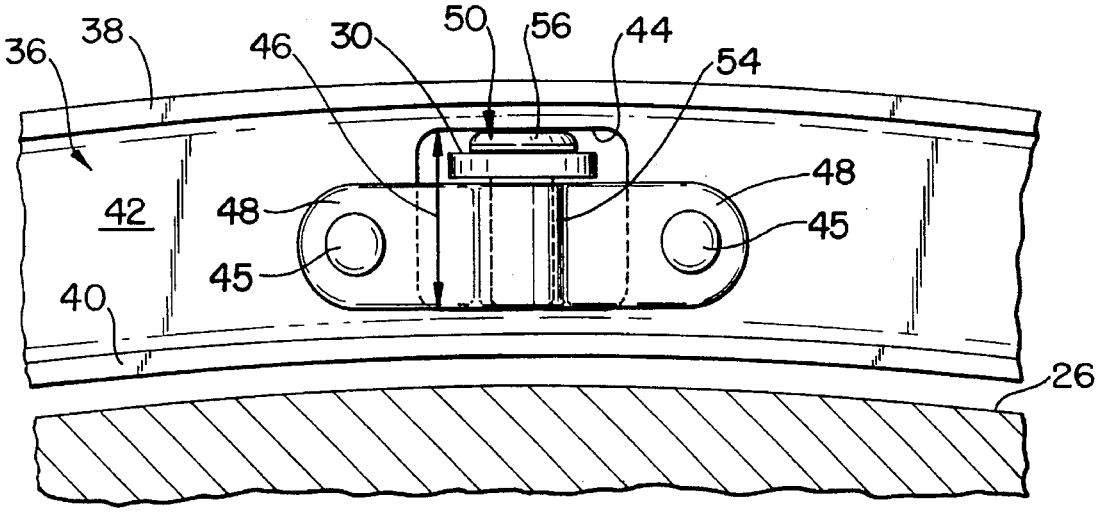
FIG. 3 is a diagrammatic view taken along line 3—3 of FIG. 4.

Referring to FIGS. 2 and 3, a synchronizing ring 36 for collectively actuating the pivot arms 30 includes a first flange 38, a second flange 40, a web 42 extending between the flanges 38, 40, and a plurality of openings 44 disposed in the web 42. The synchronizing ring 36 is assembled from two semi-circular halves connected to one another by conventional means (not shown). Alternatively, a one piece or multi-piece (not shown) ring 36 may be used. The openings 44, each of which has a height 46 (see FIG. 3), are circumferentially spaced around the ring 36 to coincide with the spacing of the variable stage vanes 24.

In the preferred embodiment, each pivot arm 30 is pivotly attached to the web 42 of the synchronizing ring 36 by a pair of brackets 48, a pin 50, and a bearing sleeve 52. The brackets 48 each include a arcuate flared section 54. The pin 50 includes a head 56 and a shaft 58. The shaft 58 is received within the bearing sleeve 52 and together the sleeve 52 and the shaft 58 are received within the aperture 34 disposed in the pivot arm 30. The head 56 prevents the pin 50 from passing through the aperture 34. Each pair of brackets 48 is centered on an opening 44, one disposed on each side of the web 42. The pin shaft 58 and bearing sleeve 52 are received within the opening 44 between the flared sections 54.

Referring to FIG. 2, a plurality of bearing pads 60 attached to the outer casing 26 guide the synchronizing ring 36 around the outer casing 26. The nacelle 62 of the engine 10 (see FIG. 1) is disposed radially outside of the synchronizing ring 36 and clearance is provided on both sides of the ring 36 to accommodate thermal growth and deflection of the ring 36 should either occur.

In the assembly of the variable stage vane actuating apparatus, the vanes 24 are pivotly mounted between the inner vane support (not shown) and the outer casing 26. The pivot arms 30 are fixed to the vane posts 28 extending up through the outer casing 26. The pins 50 are received within the bearing sleeves 52 and both are inserted within the pivot arm apertures 34. The pin 50 and pivot arm 30 assemblies are received within the openings 44 disposed within the synchronizing ring 36. The bracket pairs 48 are attached on each side of each opening 44 by conventional fasteners 45, thereby securing the pins 50 within the openings 44 and the pivot arms 30 to the ring 36. The opening height 46 is such that the pins 50 cannot pull out from between the bracket flared sections 54.

Figure 4:
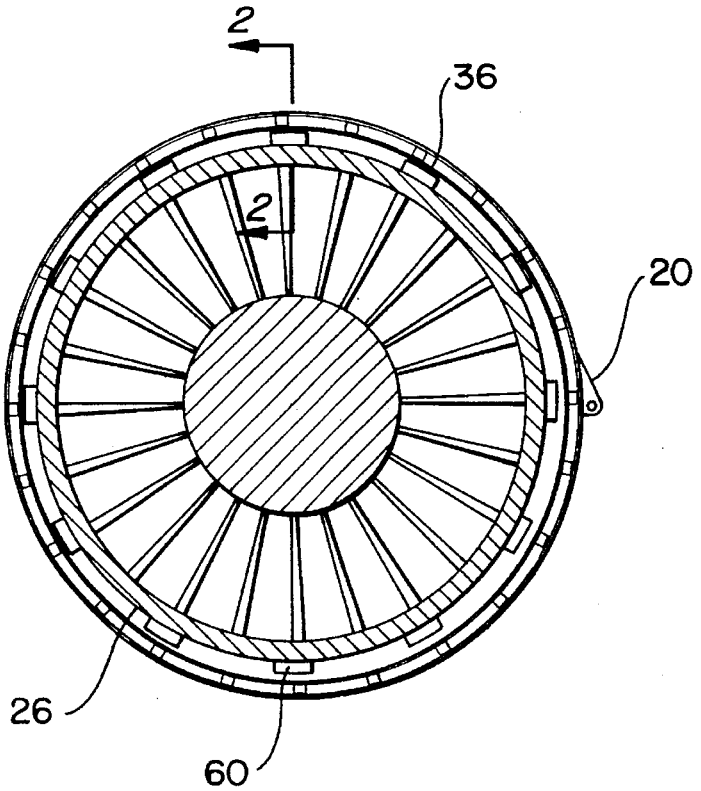
FIG. 4 is a diagrammatic partial cross-sectional view taken along line 4—4 of FIG. 1.

Referring to FIGS. 2 and 4, in the operation of the variable stage vane apparatus, air flow flowing through the compressor 14 will encounter and act against, or "load" the vanes 24 disposed in the flow path. The pivot arm 30 and synchronizing ring 36 assembly attached to the actuator 20 counteract the load and maintain the vanes 24 in a particular position. If a change in operating conditions makes it advantageous to change the vane angle of attack, the actuator 20 drives the synchronizing ring 36 a distance along the circumference of the outer casing 26. Displacement of the synchronizing ring 36 causes the pivot arms 30 and attached vanes 24 to rotate, thereby arriving at the desired vane angle of attack.

Although this invention has been shown and described with respect to a detailed embodiment thereof, it will be understood by those skilled in the art that various changes in form and detail thereof may be made without departing from the spirit and scope of the claimed invention. For example, the best mode has heretofore been described in terms of variable stage compressor vanes. The present invention apparatus may be utilized in other sections of the engine including, but not limited to, the fan inlet section.

We claim:

1. An apparatus for actuating variable stage vanes, comprising:

a plurality of pivot arms, each having a first end for fixed attachment with one of the vanes, and a second end;

a synchronizing ring, having a first flange, a second flange, a web extending between said flanges, and a plurality of openings disposed in said web; and means for pivotly attaching said pivot arms to said synchronizing ring, said means disposed within said openings.

2. An apparatus for actuating variable stage vanes according to claim 1, wherein said means for pivotly attaching comprises:

a plurality of pins, each having a head and a length, and each said pin pivotly received within an aperture disposed within said second end of each pivot arm; and a plurality of brackets, attached to said web of said synchronizing ring;

wherein said brackets maintain each said pin within one of said openings, thereby enabling each said pivot arm to pivot within said web of said synchronizing ring.

3. An apparatus for actuating variable stage vanes according to claim 2, wherein said first and second flanges of said synchronizing ring are concentric within one another and said web extends between, and is perpendicular, with said flanges.

4. An apparatus for actuating variable stage vanes according to claim 3, further comprising:

a plurality of bearing pads, disposed radially inside said synchronizing ring, wherein said bearing pads guide said synchronizing ring.

5. An apparatus for actuating variable stage vanes according to claim 4, wherein said means for pivotly attaching further comprises a bearing sleeve disposed between each said pin and said brackets.

* * * * *